United States Patent [19]

Budlane

[11] 4,087,232

[45] May 2, 1978

[54] METHOD OF ACTUATING MEANS FOR DETECTING RADIANT HEAT AND SYSTEM

[75] Inventor: Stanley J. Budlane, Fulton, Ill.

[73] Assignee: General Electric Company, Fort Wayne, Ind.

[21] Appl. No.: 673,009

[22] Filed: Apr. 2, 1976

Related U.S. Application Data

[62] Division of Ser. No. 463,299, Apr. 23, 1974, Pat. No. 3,968,469.

[51] Int. Cl.[2] ..... F23N 5/00

[52] U.S. Cl. ..... 431/66; 431/3; 337/139

[58] Field of Search ..... 431/2, 66, 28, 3; 337/141, 139, 394, 390; 200/122, 137; 250/395, 374, 379, 382, 526; 432/37, 43

[56] References Cited

U.S. PATENT DOCUMENTS

| | | | |
|---|---|---|---|
| 2,412,483 | 12/1946 | Warrington | 337/139 |
| 3,256,410 | 6/1966 | Bastian | 337/139 X |
| 3,527,446 | 9/1968 | White | 432/43 |
| 3,532,451 | 10/1970 | Willson | 431/66 |
| 3,569,710 | 3/1971 | Jalink, Jr. | 250/395 |
| 3,776,684 | 12/1973 | Wright | 431/66 |

*Primary Examiner*—Edward G. Favors
*Assistant Examiner*—Larry Jones
*Attorney, Agent, or Firm*—Joseph E. Papin

[57] ABSTRACT

A method of actuating means for detecting radiant heat from a source thereof with the detecting means having a pair of metallic strips with adjacent oppositely spaced portions thereof interconnected. This method includes the steps of: shielding at least a part of one of the strips from the radiant heat source while subjecting the other of the strips thereto for effecting relative elongation of the strips and causing one of the interconnected adjacent oppositely spaced portions of the strips to pivot relative to the other of the interconnected adjacent oppositely spaced portions thereof; and effecting the movement of means toward at least one position for controlling an electrical circuit in response to the pivotal movement of the strips.

A system is also disclosed.

24 Claims, 11 Drawing Figures

METHOD OF ACTUATING MEANS FOR DETECTING RADIANT HEAT AND SYSTEM

CROSS-REFERENCE TO RELATED APPLICATION

This application is a division of U.S. patent application Ser. No. 463,299 filed Apr. 23, 1974 (now U.S. Pat. No. 3,968,469 issued July 6, 1976) which is incorporated herein by reference.

BACKGROUND OF THE INVENTION

This invention relates generally to heat controls and in particular to a method of actuating means for detecting radiant heat and a system in which the detecting means is utilized.

In the past, various types of detectors for radiant heat have been employed for controlling electrical circuits to effect, under preselected conditions, a flow of combustible gas and the ignition thereof so as to regulate the temperature of an appliance or apparatus, such as a gas dryer of the like for instance. In a past method for actuating such a detector, a generally U-shaped bimetal strip was subjected to radiant heat for completing an electrical circuit through the detector, but one of the disadvantageous or undesirable features thereof is believed to be that the bimetal acted generally as a long spring having a relatively high mass at the contact end thereof which was subject to low frequency vibrations. Another disadvantageous or undesirable feature of a past method for actuating such a detector is believed to be that during a change of ambient temperature, the detector portion of the bimetal deflected considerably necessitating the compensating portion of the bimetal to deflect the same and exact amount in opposition. Still another disadvantageous or undesirable feature of a past method for actuating such a detector is believed to be that the current flow in the electrical circuit was through the bimetal strip. Such current flow through the bimetal not only dictated the size thereof but also affected its operating characteristics by adding heat thereto. In other such past methods of actuating such detectors, the one of the thermo-responsive elements for controlling an electrical circuit through the detector is believed to be completely encapsulated by another thermal responsive element, and a disadvantageous or undesirable feature of this past detector is believed to be that the response time was too slow due to the complete shielding.

SUMMARY OF THE INVENTION

Among the several objects of the invention may be noted the provision of a system and a method of actuating means for detecting radiant heat which overcomes the disadvantageous or undesirable features discussed hereinabove, as well as others, with respect to the prior art; the provision of such method and system in which a thermo-responsive actuator for driving a means for controlling an electrical circuit are electrically isolated from each other; the provision of such method and system in which the thermo-responsive element is unaffected by changes in the ambient or environmental temperature; and the provision of such method and system in which the components thereof are simplified in design, economically manufactured and easily assembled.

In general, a method is provided in one form of the invention for actuating means for detecting radiant heat from a source thereof with the detecting means having a pair of metallic strips with adjacent oppositely spaced portions thereof interconnected. In this method, at least a part of one of the strips is shielded from the radiant heat source while the other of the strips is subjected thereto for effecting relative elongation of the strips and causing one of the interconnected adjacent oppositely spaced portions of the strips to pivot relative to the other of the interconnected adjacent oppositely spaced portions thereof. The movement of means toward at least one position is effected for controlling an electrical circuit in response to the pivotal movement of the strips.

Also in general, a method is provided in one form of the invention for actuating a pair of elongate strips respectively having a pair of adjacent opposite portions interconnected in a generally triangularly shaped truss mounted for pivotal movement in means for detecting radiant heat from a source thereof. This method includes shielding, at least in part, one of the strips from the radiant heat while subjecting the other of the strips thereto so as to effect elongation of the other strip with respect to the one strip and cause one of the pair of adjacent opposite portions of the strip to pivot generally about the other pair of adjacent opposite end portions of the strips.

Also in general and in one form of the invention a system is provided for operating apparatus utilizing a combustible gas. In this system, means for emitting radiant heat is connected in circuit relation with means for supplying the combustible gas to be ignited, and means adapted to control the circuit relation is provided for selectively effecting energization of the emitting means and said supplying means. A pair of metallic strips with portions thereof respectively interconnected have means for pivotally mounting the strips spaced from the interconnected portions thereof and disposed so as to separate the strips. One of the strips is shielded at least in part with respect to the heat generated by the emitting means and the supplying means upon the energization thereof, and the other of the strips is subjected to the heat so as to effect elongation thereof with respect to the one strip and the pivotal movement of the interconnected portions of the strips generally about the pivotally mounting means. Means is disposed between at least one of the one and other strips and the energization means for driving it to a circuit controlling position respectively deenergizing the emitting means and the supplying means so that the combustible gas from the supplying means is ignited by the remaining, radiant heat of the emitting means.

BRIEF DESCRIPTION OF THE DRAWINGS

Corresponding reference characters indicate corresponding parts throughout the several views of the drawings.

The exemplifications set out herein illustrate the preferred embodiments of the invention in one form thereof and such exemplifications are not to be construed as limiting the scope of the disclosure or the invention in any manner.

DETAILED DESCRIPTION OF THE PREFERRED EMBODIMENTS

Figure 5:
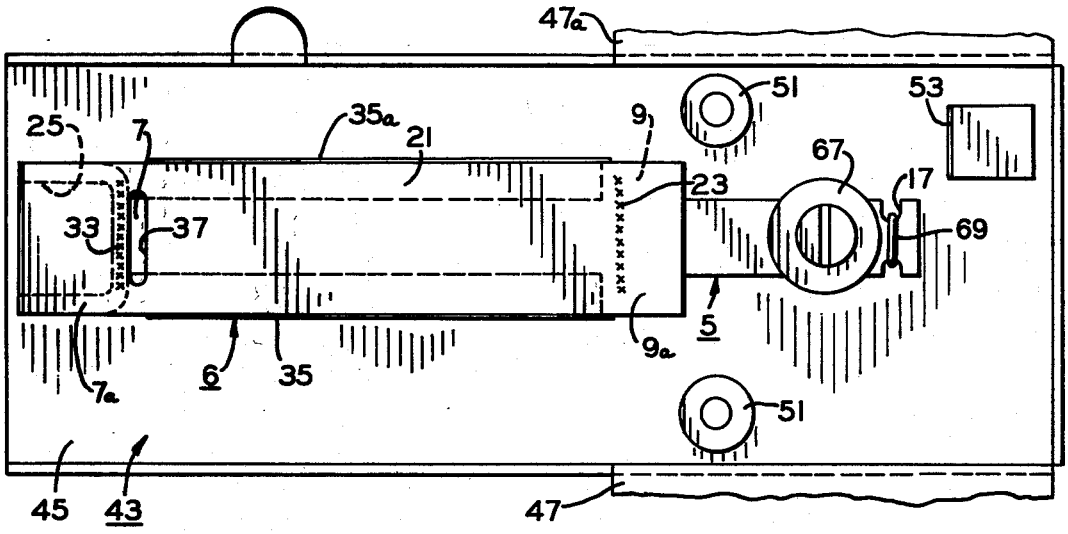
FIG. 5 is a bottom view of the detector of the detector of FIG. 1 with the housing thereof partially broken away.
Figure 9:
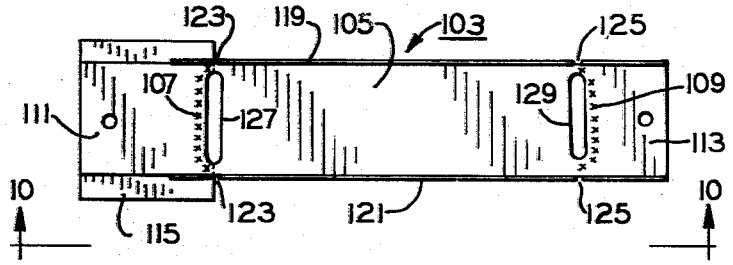
FIGS. 9–11 are enlarged plan, front and right side elevational views showing actuating means of the detector of FIG. 7 disassociated therefrom.
Figure 10:
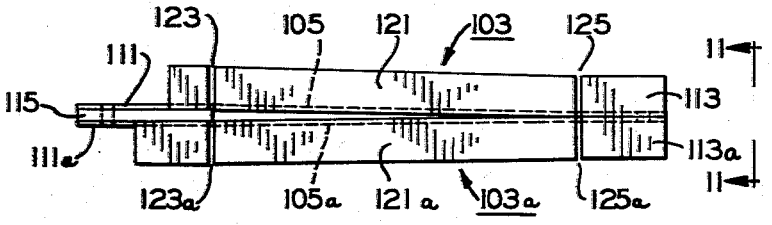
Figure 11:
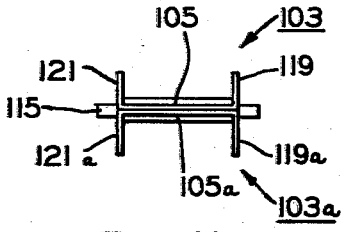
Figure 6:
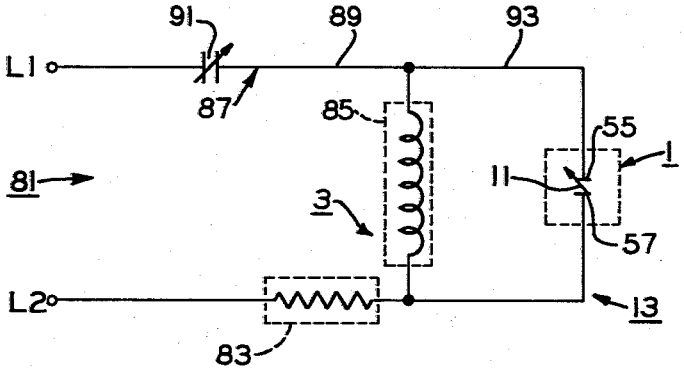
FIG. 6 is a schematic view illustrating a system in one form of the invention in which the detector of FIGS. 1 and 7 is utilized.

Referring now to the drawings in general, there is illustrated a method in one form of the invention of actuating or operating means, such as a detector or sensor 1, for detecting or sensing radiant heat (FIGS. 1–5) from a source thereof, indicated generally at 3 (FIG. 6). In this method, a pair of metallic strips 5, 6 are respectively provided with adjacent oppositely spaced portions or end portions 7, 7*a* and 9, 9*a* which are interconnected (FIGS. 1–5). At least a part of one of the strips 5 is shielded from radiant heat source 3 while the other of the strips 6 is subjected thereto for effecting relative elongation of the strips thereby causing one of the interconnected adjacent oppositely spaced portions 9, 9*a* of the strips to pivot relative to the other of the interconnected adjacent oppositely spaced portions 7, 7*a* thereof. Movement of means, such as a switch blade 11, is effected toward a position for controlling an electrical shunting circuit 13 (FIG. 6) in response to the pivotal movement of strips 5, 6.

Figure 1:
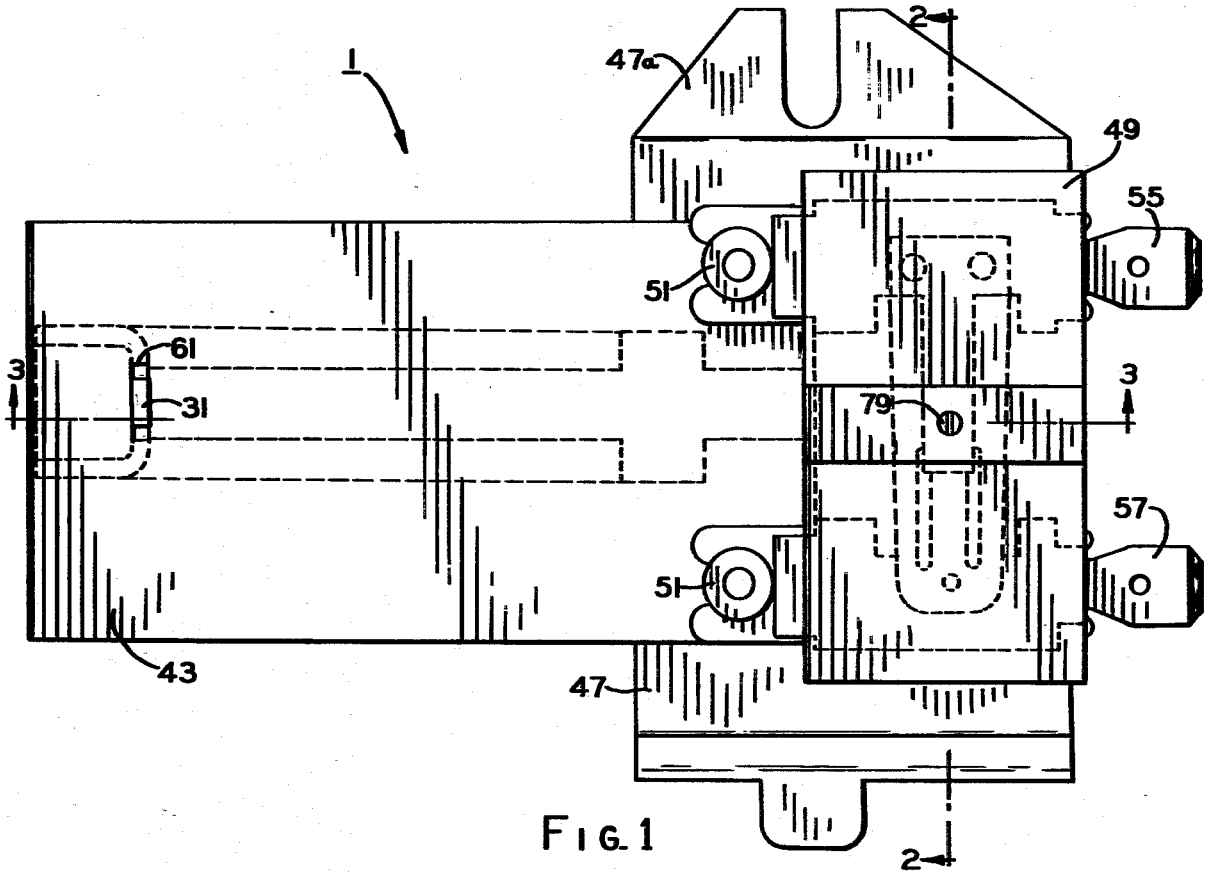
FIG. 1 is a plan view illustrating a detector for radiant heat and teaching principles of a method for actuating such detector in one form of the invention.
Figure 2:
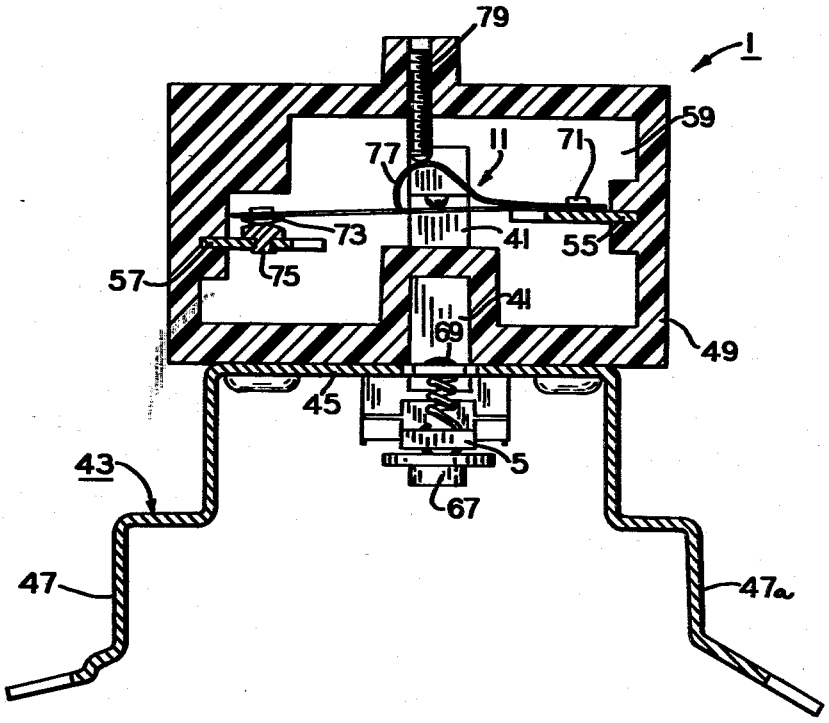
FIGS. 2 and 3 are respectively sectional views taken generally along lines 2—2 and 3—3 of FIG. 1.
Figure 3:
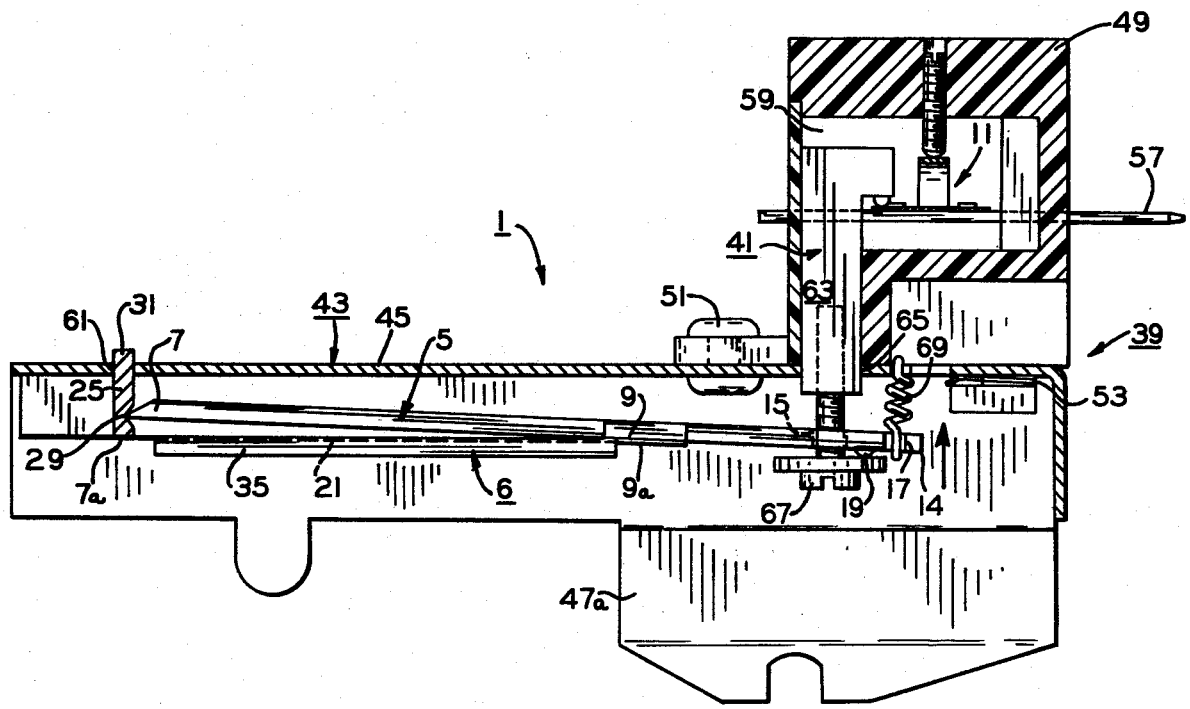

More particularly and with reference to FIGS. 1–5, strips 5, 6 are formed of like metal having good thermal expansion or elongation characteristics, such as stainless steel or the like for instance, and the strips are generally of dissimilar shape. However, it is contemplated that similar shaped strips could be employed within the scope of the invention, as discussed hereinafter. Strip 5 is generally planer and in the shape of a cross having opposite arms or laterally extending portions integrally formed adjacent the mid-portion of the strip, and a knife or pivoting edge is provided on the leftward end of the strip (as seen in FIG. 3), the knife edge and laterally extending arms generally comprising the oppositely spaced portions 7 and 9 of the strip. Strip 5 is also provided with a distal, free, or rightward end or end portion 14 in which is provided an adjustment screw receiving aperture or opening 15 and a spring receiving opening or slot 17, and means, such as a button 19, is provided on the strip adjacent opening 15 for pivotal engagement purposes, as discussed hereinafter. Strip 6 is generally channeled or U-shaped in cross-section having an elongate base 21 disposed generally closely adjacent and in overlaying relation with strip 5. Strip 6 is provided with a pair of opposite ends or end portions which, in general, comprise the oppositely spaced portions 7*a*, 9*a* of the strip, and it may be noted that oppositely spaced portions 9, 9*a* of strips 5, 6 are disposed adjacent each other being interconnected by suitable means, such as a weld 23, as shown in FIG. 5.

Figure 4:
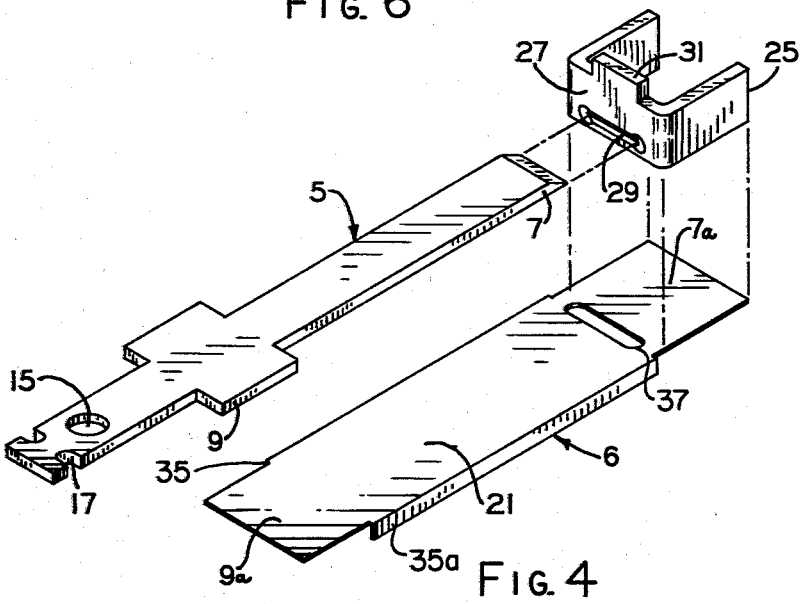
FIG. 4 is an exploded perspective view of actuating means of the detector of FIG. 1 disassociated therefrom.
Figure 7:
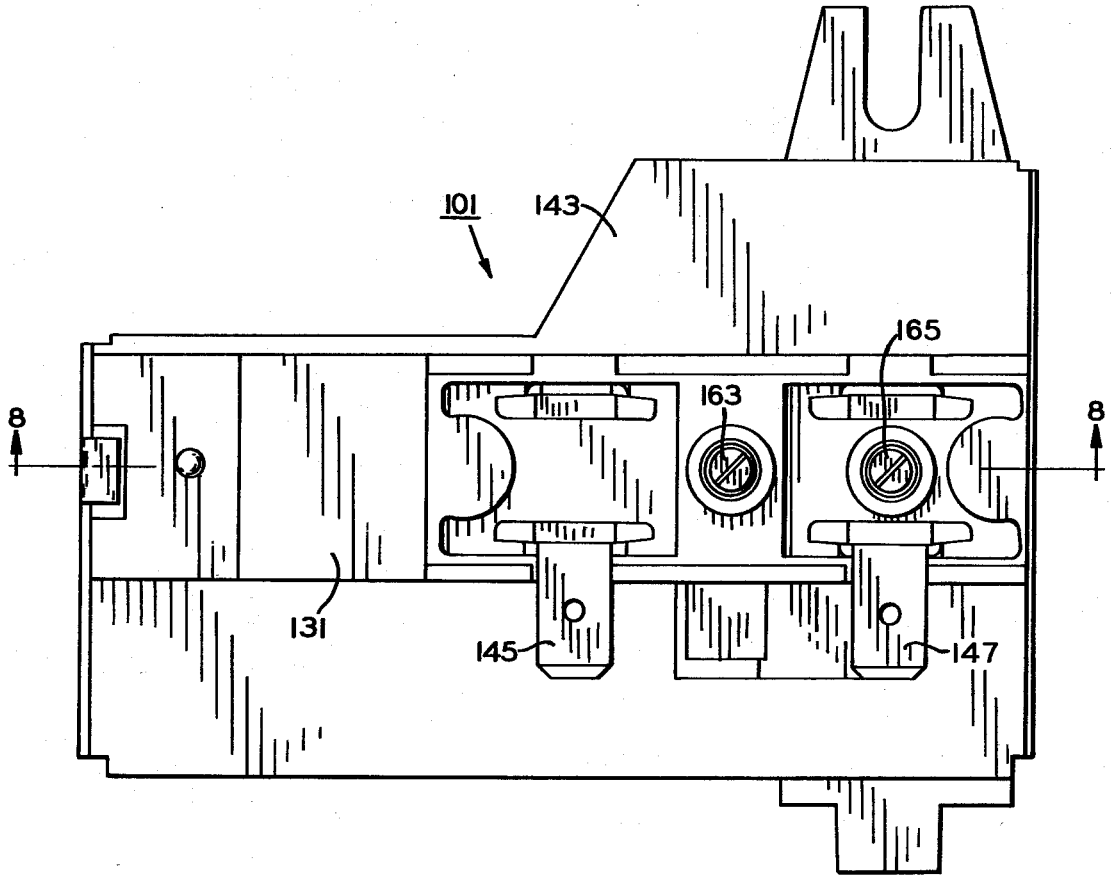
FIG. 7 is a plan view illustrating an alternative detector for radiant heat and teaching principles of a method for actuating means for detecting radiant heat in one form of the invention.

Means, such as a spacer 25, for mounting strips 5, 6 and for spacing them in detector 1 is generally U-shaped in cross-section, and a base 27 thereof is provided with a generally cross-wise, V-shaped groove or slot 29 which pivotally receives the knife edge 7 of strip 5. A mounting flange 31 is integrally formed with spacer base 27 on the upper end or edge portion thereof for mounting spacer 25 and strips 5, 6, as discussed hereinafter. It may be noted that adjacent oppositely spaced portions 7, 7*a* of strips 5, 6 are generally disposed adjacent each other, and leftward end or oppositely spaced portion 7*a* of strip 6 is connected to the lower end, abutment surface or edge portion of spacer 25 by suitable means, such as a weld 33, as shown in FIG. 5, while knife edge or oppositely spaced portion 7 is positioned in pivotal engagement with slot or groove 29 provided in base 27 of spacer 25. In this manner, it may be noted that spacer 25 is interconnected between adjacent oppositely spaced portions 7, 7*a* of strips 5, 6 predeterminately spreading or spacing them apart so that the strips and spacer form a truss having a generally rigid triangular shape or configuration, as seen in FIG. 3, for enhancing pivotal movement of the strips, as discussed hereinafter. Of course, it is desirable that strips 5, 6 not only be pivotally movable but also strong or stiff enough to effect operation of switch blade 11. To this end, it may be noted that strip 5 has a thickness greater than that of strip 6, however, opposite sides or ribs 35, 35*a* are integrally formed with base 21 of strip 6, as shown in FIGS. 3 and 4, thereby to afford a desired degree of rigidity or stiffness thereto. In order to further enhance pivotal movement of strip 6, a notch, aperture or slot 37 is provided in base 21 of the strip extending between opposite sides 35, 35*a* thereof and being predeterminately disposed at or closely adjacent to weld 23 which connects the base of the strip to the lower edge of spacer 25. In this vein, it may be also noted that weld 23 interconnects adjacent oppositely spaced portions 9, 9*a* of strips 5, 6 generally at or adjacent the rightward end of sides 35, 35*a* to enhance the pivoting characteristic of strip 6. Since strips 5, 6 are of like metal, as previously mentioned, it may be noted that they are generally unaffected by changes in the ambient or environmental temperature to which they may be exposed. Further, it may be noted that base 21 of strip 6 shields at least a part of strip 5 from radiant heat, as discussed in detail hereinafter, to establish a thermal differential between the strips. This thermal differential acting across strips 5, 6 effects expansion or elongation of strip 6 relative to strip 5 thereby to cause the interconnected adjacent oppositely spaced portions 9, 9*a* of the strips to pivot generally in opposite directions and relative to the other interconnected adjacent oppositely spaced portions 7, 7*a* of the strips which are supported by spacer 25, as discussed hereinafter. Thus, the pivotal movement of strips 5, 6 in response to the established thermal differential thereacross or therebetween drives or effects the movement of switch blade 11 toward its circuit controlling position, as previously mentioned.

Referring now again in general to FIG. 3 and in part reviewing the aforementioned structure of detector 1, the detector is provided with a housing, indicated generally at 39, and means, such as switch blade 11, is movable in the housing between positions for controlling electrical shunt circuit 13 therethrough. Means is disposed in housing 39 for actuating the controlling means or switch blade 11, and the actuating means includes metallic strips 5, 6 disposed generally in overlaying relation with adjacent portions 9, 9*a* thereof respectively interconnected. One of strips 5, 6 is adapted to be subjected directly to the radiant heat while generally shielding at least a part of the other of the strips 5 therefrom. Means, such as spacer 25, is spaced from interconnected adjacent portions 9, 9a of strips 5, 6 for separating them, and strip 6 is elongatable upon the subjection of radiant heat thereto relative to the shielded strip 5 for effecting pivotal movement of the strips generally about the separating means or spacer 25. Means, such as a connecting link or pin 41, disposed between at least one of the strips 5, 6 and switch blade 11 effects movement thereof to at least one of its circuit controlling positions upon the pivotal movement of the strips.

More particularly and with reference to FIGS. 2 and 3, a metal bracket 43 is provided with a generally elongate channel section or base 45 having depending flanges or sides 47, 47a integrally formed adjacent the opposite sides of base 45 so as to generally comprise a trough-like chamber, and the opposite sides may be provided as a means for mounting detector 1 with respect to radiant heat source 3 of FIG. 6 so as to pass the radiant heat from the source to the chamber. A cover 49 may be formed from a material having good thermal insulating properties such as, a phenolic material or the like, and the cover is secured to base 45 of bracket 43 by suitable means, such as a plurality of rivets 51 and/or a spring clip 53. A pair of terminals 55, 57 are fixedly disposed in cover 49 for connection in electrical circuit 13 and extend generally through the cover into a cover chamber 59. It may be noted that bracket 43 and cover 49 constitute housing 39.

Bracket 43 is slotted at 61, and flange 31 of spacer 25 extends through slot 66 into mounting and positioning engagement with the bracket. Spacer flange 31 is fixedly connected to bracket 43 by suitable means, such as welds (not shown), and in this manner, as previously mentioned, spacer 25 and strips 5, 6 are disposed or mounted generally in a cantilevered manner on detector 1 and generally forms the aforementioned truss having a generally triangular configuration. It may be noted that strip 6 is disposed generally adjacent base 45 of bracket 43 and that strip 6 is directly subjected to radiant heat shielding at least a part of strip 5 from the radiant heat. As previously mentioned, connecting link or pin 41 is disposed for engagement between strip 5 and switch blade 11 to control the position of the switch blade in response to the pivotal movement of strips 5, 6.

A plunger 63 is slidably or reciprocably movable in cover chamber 59 and extends through an aperture or opening 65 provided therefor in bracket base 45, and an adjusting screw 67 is threadedly received in the lower end of the plunger. Adjusting screw 67 extends through opening 15 provided therefor in end 14 of strip 5, and pivoting means or button 19 is provided on the strip adjacent the opening for pivotal or following engagement between the strip and the head of the adjusting screw. Plunger 63 and adjusting screw 67 in general comprise connecting link 41. It may be noted that resilient means, such as a spring 69, is connected between bracket base 45 and spring receiving opening 17 provided in the distal or free end of strip 5. The compressive force of spring 69 not only urges strips 5, 6 generally upwardly or in a counterclockwise direction about spacer 25, as indicated by the directional arrow in FIG. 3, but also is effective to maintain knife edge or oppositely spaced portion 7 against displacement from its cooperating, generally V-shaped pivoting groove 29 in spacer base 27. Of course, adjusting screw 67 is generally operable to adjust the pivotal movement or travel of switch blade 11, as discussed hereinafter.

Switch blade 11 is of the overcenter type well known in the art for effecting snap-action and is illustrated herein only for purposes of disclosure, it being understood that other switch blades of both the snap-acting and slow acting types may be utilized within the scope of the invention so as to meet the objects and advantageous features thereof. One end of switch blade 11 is fixedly mounted to the interior end of terminal 55 within cover chamber 59 by suitable means, such as a rivet 71, and a movable contact 73 is mounted on the distal, movable, or free end of the switch blade for making engagement and breaking disengagement with a another contact 75 which may be stationary and which is riveted or otherwise connected with the interior end of terminal 57 within the cover chamber. A biasing spring or resilient portion 77 is lanced from switch blade 11 and tensioned with respect thereto, and when strips 5, 6 are in their normal position, i.e. acting to tension spring 69, the strips create a force acting generally in opposition to the directional arrow in FIG. 3 which overcomes the inherent resiliency of the biasing spring so as to urge the switch blade to its circuit controlling position engaging movable contact 73 with stationary contact 75. Adjusting means, such as a screw 79, is threaded through cover 49 for adjusting engagement with biasing spring 77 of switch blade 11, and of course, the screw adjustably loads biasing spring to predetermined the force necessary for moving the switch blade with characteristic snap action to its circuit controlling position disengaging movable contact 73 from stationary contact 75.

Referring now to FIG. 6, a system, indicated generally at 81, in one form of the invention is provided for operating apparatus, such as a gas dryer or the like (not shown) which utilizes a combustible gas. System 81 includes means, such as a glo-coil 83 or the like, which is energized upon the application of power thereto for emitting radiant heat and also means, such as a solenoid actuated gas valve 85, which is energized upon the application of power thereto for supplying a flow of the combustible gas adapted to be ignited by the radiant heat of the emitting means. Emitting means or glo-coil 83 is available from the Carborundum Co., Refractories and Electronics Division, Niagara Falls, New York, and supplying means or solenoid actuated gas valve 85 is available from the White-Rogers Division of Emerson Electric Co., St. Louis, Missouri. Means, such as detector 1, is connected in shunt circuit relation across supplying means or gas valve 85 and in series circuit relation with glo-coil 83 for controlling the energizations thereof and, as previously mentioned, includes means, such as switch blade 11, for applying power to the glo-coil to effect the energization thereof and its emission of the radiant heat under preselected conditions. Applying means or switch blade 11 is also movable toward a position for interrupting the application of power to glo-coil 83. As previously mentioned with respect to FIGS. 2–5, elongate metallic strips 5, 6 have portions 9, 9a thereof respectively interconnected, and means, such as spacer 25, is spaced from the interconnected portions of the strips for separating them. Means, such as mounting flange 31 on spacer 25, mounts at least the spacer so that strips 5, 6 are pivotally movable relative thereto and wherein strip 6 is subjected to heat source 3 while shielding at least a part of strip 5 from the heat source. Strip 6 is elongatable upon the subjection thereof to heat source 3 relative to shielded strip 5 thereby to effect the pivotal movement of the strips, and means, such as connecting link 41, is disposed between at least one of strips 5, 6 and switch blade 11 for effecting or controlling movement thereof toward its position interrupting the application of power to glo-coil 83 to effect the de-energization thereof. Power is thereafter applied to gas valve 83 to effect the energization thereof and the flow of the combustible gas for ignition by the remaining radiant heat of glo-coil 81.

More particularly, system 81 includes an electrical circuit 87 having a lead 89 connected in series circuit across power terminals $L_1$, $L_2$. A thermostat 91 of a type well known in the art is connected in series circuit relation in lead 89 with glo-coil 83 and solenoid actuated gas valve 85 which comprise radiant heat source 3. Detector 1 has its terminals 55, 57 serially connected through switch blade 11 in a lead 93 which is connected in shunt circuit relation across gas valve 85. The lead 83, terminals 55, 57, and switch blade 11 generally comprise shunt circuit 13.

OPERATION

In the operation with the component parts of detector 1 positioned as above described and shown in the drawings, thermostat 91 is responsive to preselected high and low values of temperature in the environment of system 81 to respectively energize and de-energize circuit 87. Assuming that the resistance through detector 1 is less than that through gas valve 85, power will flow through shunt circuit 13 by-passing or shunting the gas valve when thermostat 91 is actuated or "calling" in response to the pre-determined low temperature value to energize circuit 87 across power terminals $L_1$, $L_2$. Since movable and stationary contacts 73, 75 of detector 1 are in making engagement, as described herein before, power is applied through switch blade 11 and detector terminals 55, 57 to energize glo-coil 83 so that it will emit radiant heat. Detector 1 is so disposed with respect to glo-coil 83 and gas valve 85 that radiant heat from either of them will serve to effect operation of the detector. The radiant heat generated by glo-coil 83 in response to the energization thereof is transmitted to housing 39 of detector 1, and it may be noted that the radiant heat so transmitted acts directly on strip 6 effecting a heat rise therein; however, since strip 6 shields strip 5 from the radiant heat, there is established the thermal differential therebetween, as previously mentioned. Strip 6 will elongate generally to the right (as seen in FIG. 3) in response to the radiant heat acting thereon, and in this manner, elongation of strip 6 relatively to shielded strip 5 pivotally moves the interconnected adjacent oppositely spaced portions **9, 9*a* of the strips about the generally stationary interconnected adjacent oppositely spaced portions 7, 7*a* of the strips and spacer 25 thereby to effect pivotal movement of the strips generally in a counterclockwise direction, as indicated by the arrow in FIG. 3. In other words, when strip 6 expands, the interconnected adjacent oppositely spaced portions 9, 9*a* of strips 5, 6 are pivoted generally upwardly since strip 5 and spacer 25, which generally form two sides of the aforementioned triangular configuration, are constant while strip 6, which forms the third side of aforementioned triangular configuration, expands or elongates. It maybe noted that the knife edge or oppositely spaced portion 7 of strip 5 pivots in its cooperating groove 29 in spacer base 27 upon the pivotal movement of strips 5, 6, as previously mentioned. The force generated in response to the pivotal movement of strips 5, 6 is assisted by the compressive force of spring 69, and the distal or free end of strip 5 is moved generally upwardly away from adjusting screw 67; however, the biasing force of switch blade biasing spring 77 is exerted on plunger 63 thereby to effect following movement of the plunger with the pivotal movement of the strips so as to maintain the head of the adjusting screw in following engagement with button 19 on strip 5. In this manner, the force generated in response to the pivotal movement to the strips 5, 6 is translated through connecting link 41 to effect or permit movement of switch blade 11 in response to the biasing force of its biasing spring 77 toward the aforementioned circuit interrupting position disengaging movable contact 73 from stationary contact 75 thereby to open shunt circuit 13 and de-energize glo-coil 83. Upon disengagement of contact 73, 75 to open shunt circuit 13, power is now applied through lead 89 to effect energization of solenoid operated gas valve 85. When gas valve 85 is so energized, it provides a flow of combustible gas which is then ignited by the remaining radiant heat emitted from glo-coil 83 which remains glowing due to its time constant for a period subsequent to its de-energization sufficient to ensure good ignition of the flowing combustible gas. Placing gas valve 85 in series circuit relation with glo-circuit 83 acts to reduce current applied to the glo-coil to an insignificant value thereby to effect the deactuation or de-energization thereof terminating its emission of radiant heat in accordance with its time constant. However, since the combustible gas flowing from energized gas valve 85 is ignited, the heat thereof will act on strip 6 to maintain strips 5, 6 in their pivoted or actuated position for effecting movement of switch blade 11 to its circuit controlling position opening shunt circuit 13**.

When thermostat 91 senses the predetermined high temperature value, it opens circuit 87 across power terminals $L_1$, $L_2$ thereby to effect de-energization of gas valve 85 wherein the supply or flow of gas is interrupted. With the gas flow so interrupted, the flame or burning gas is, of course, extinguished thereby to interrupt or abruptly decrease radiant heat transmitted to detector 1. As the intensity of the radiant heat decreases, strip 6 of detector 1 cools so as to eventually eliminate the aforementioned thermal differential between strips 5, 6, and upon such cooling, strip 6 contracts from its heated elongated position or dimension. This cooling contraction of strip 6 causes strips 5, 6 to pivotally return to their original position in housing 39. The return pivotal movement of strips 5, 6 to their original position against the compressive force of spring 69 and the biasing force of switch blade spring 77 creates a force which is transmitted through adjusting screw 67 to drive plunger 63 conjointly downwardly with the strips. The generally dowardly or pivotally directed force of strips 5, 6 drives connecting link 41 downwardly overcoming the force of biasing spring 77 of switch blade 11 thereby to move it with characteristic snap-action to its original position re-engaging movable contact 73 with stationary contact 75. As will be recalled, thermostat 91 opened circuit 87 across power terminals $L_1$, $L_2$; therefore, the application of power across detector 1 through now closed contacts 73, 75 is obviated. It may be noted, however, that the closing of contact 73, 75 resets detector 1 for a subsequent or cyclical operation of system 81 when thermostat 91 again senses the predetermined low temperature value, as perviously described.

Referring now to FIGS. 7–11, there is shown an alternative detector 101 for sensing or detecting radiant heat, and detector 101 functions in system 81 generally in the same manner as the previously described detector 1. It may be noted that a method for actuating detector 101 is generally the same as that discussed hereinabove with respect to detector 1 with exceptions as may be noted or which may become apparent in the following description of detector 101, it may also be noted that the method for actuating detector 101 may have additional objects and advantageous features which are apparent or pointed out hereinafter.

Detector 101 is provided with strips **103, 103*a* which are formed of like metal having good thermal expansion or elongation characteristics, such as stainless steel or the like for instance, and the strips also have generally the same shapes being disposed in inverted relation with respect to each other. Strips 103, 103*a* are generally channeled or U-shaped in cross-section, and generally elongate bases 105, 105*a* of the strips are disposed generally closely adjacent and in base-to-base overlaying relation with each other. Bases 105, 105*a* are interconnected by suitable means, such as a pair of welds 107, 109 or the like, provided adjacent opposite ends or end portions 111, 111*a* and 113, 113*a* of strips 103, 103*a*, and a spacer 115 is interposed or fixedly interconnected by weld 107 between end portions 111, 111*a*. Spacer 115 predeterminately spreads strips 103, 103*a* apart so that the strips and spacer form a truss having a rigid generally triangular shape or configuration for enhancing pivotal movement of the strips, as discussed hereinafter. Of course, it is desirable that strips 103, 103*a* not only be pivotally movable but also strong or stiff enough to drive a switch blade 117. To this end, bases 105, 105*a* are integrally disposed between a pair of opposite sides or ribs 119, 121 and 119*a*, 121*a* which afford some degree of rigidity or stiffness to strips 103, 103*a*. In order to further enhance pivotal movement of strips 103, 103*a*, pairs of opposite notches or slots 123, 125 and 123*a*, 125*a* are provided in sides 119, 121 and 119*a*, 121*a* of the strips, and a pair of generally elongate apertures or openings 127, 129 and 127*a*, 129*a* are provided through bases 105, 105*a* generally in alignment with each other and extending between the sides. It may be noted that welds 107, 109 are provided closely adjacent or at slots 123, 125 and 123*a*, 125*a* and also closely adjacent or at openings 127, 129 and 127*a*, 129*a*, respectively. Since strips 103, 103*a* are of like metal, as previously mentioned, it may be noted that they are generally unaffected by changes in the ambient or environmental temperatures to which they may be exposed. Further, since strips 103, 103*a* are generally of the same shape with their bases 105, 105*a* interconnected in overlaying relation, it may also be noted that strip 103*a* shields strip 103 from radiant heat, as discussed in detail hereinafter, to establish a thermal differential therebetween. This thermal differential acting across strips 103, 103*a* effects expansion or elongation of strip 103*a* relative to strip 103 thereby to cause end portions 113, 113*a* of the strip to pivot relative to end portions 111, 111*a* which are held stationary, as described hereinafter. Thus, the pivotal movement of strips 103, 103*a* in response to the established thermal differential thereacross drives switch blade 117. It may be noted that strips 103, 103*a* and spacer 115 generally comprise actuating means for detector 101**.

More particularly, detector 101 is provided with a housing 131 which may be formed from a material having good thermal insulating properties, such as a phenolic material or the like, and a stepped chamber 133 is provided in the housing having a base wall 135 and a shoulder 137. Means, such as an opening or window 139, is provided in the lower end of housing 131 for passing radiant heat into chamber 133, and material having good thermal transfer properties, such as a pane of glass 141 or the like through which radiant heat may pass into chamber 133, is provided in the window. A mounting bracket 143 for detector 101 is secured to housing 131 by suitable means (not shown), and at least a portion of the bracket is engaged with glass 141 to retain it against displacement from the housing. A pair of terminals 145, 147 are fixedly disposed in housing 131 for connection in electrical circuit 13 (FIG. 6) and extend generally through base wall 135 into housing chamber 133.

Adjacent opposite end portions **111, 111*a* and spacer 115 are mounted to housing shoulder 137 by suitable means, such as a rivet 149, so that strips 103, 103*a* are disposed or supported in a cantilevered manner or generally in a truss fashion within housing chamber 133. It may be noted that strip 103*a* is disposed adjacent housing window 139 directly in the path of radiant heat penetrating glass 141 and that strip 103*a* shields strip 103 from the radiant heat. A drive or connecting link or pin 151 is disposed in driving or abutting engagement between adjacent opposite end portions 113, 113*a* of strips 103, 103*a* and switch blade 117** for translating pivotal movement of the strips to the switch blade.

Switch blade 117 is of the over center type well known in the art for effecting snap-action and is shown for purposes of disclosure, it being understood that other switch blades of either a snap-acting of slow-acting type may be utilized within the scope of the invention so as to meet the objects and advantageous features thereof. One end of switch blade 117 is fixedly mounted to the interior end of terminal 145 by suitable means, such as a rivet 153, and a contact 155 is mounted on the distal or movable free end of the switch blade for making engagement and breaking disengagement with a another contact 157 which may be stationary and which is riveted or otherwise connected with the interior end of terminal 47. A biasing spring or resilient portion 159 is lanced from switch blade 117 and tensioned by a strut 161 retained in engagement between a portion of contact 155 and a bowed or free end portion of the biasing spring. In this manner, biasing spring 159 normally urges movable contact 155 on switch blade 117 toward making engagement with stationary contact 157. Adjusting means, such as a screw 163 is threaded through housing base wall 135 for adjusting engagement with biasing spring 159 of switch blade 117, and of course, the screw adjustably loads the biasing spring to predetermine the force necessary for moving the switch blade to a circuit controlling or position disengaging contact 155 from stationary contact 157. To complete the description of detector 101, another adjusting means, such as another screw 165, is threadedly received through housing base wall 135 for adjusting engagement with movable contact 155 to predetermine the travel of switch blade 117 between its circuit making and breaking positions with respect to stationary contact 157.

As previously noted, detector 101 operates in system 81 generally in the same manner as the previously described detector 1, and albeit now shown, terminals 145, 147 of detector 101 may be serially connected through switch blade 117 in lead 93 which is connected in shunt circuit relations across the gas valve 85.

Figure 8:
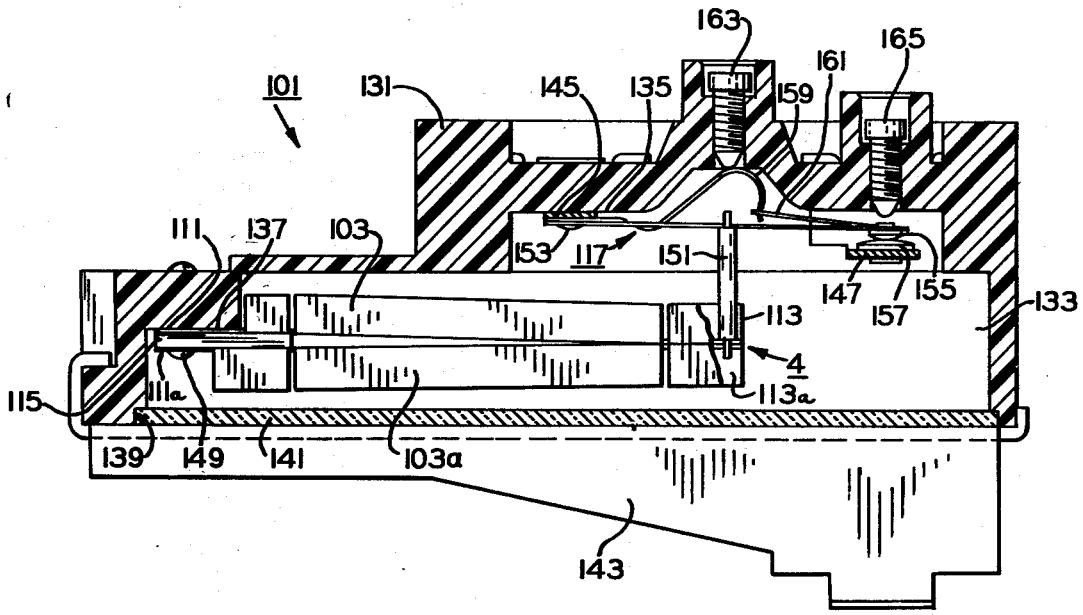
FIG. 8 is a sectional view taken generally along line 8—8 of FIG. 7.

In the operation with the component parts of detector 101 positioned as above described and as shown in the drawings, thermostat 91 is responsive to preselected low and high values or temperature in the environment of system 81 to respectively energize and de-energize circuit 87. Assuming that the resistance through detector 101 is less than that through gas valve 85, power will flow through shunt circuit 13 by-passing or shunting the gas valve when thermostat 91 is actuated in response to the predetermined low temperature value to energize circuit 87 across load terminals $L_1$, $L_2$. Since movable and stationary contacts 155, 157 of detector 101 are normally in making engagement, power is applied through switch blade 117 and detector terminals 145, 147 to energize glo-coil 83 so that it will emit radiant heat. Detector 101 is so disposed with respect to glo-coil 83 and gas valve 85 that radiant heat from either of them will serve to effect operation of the detector. The radiant heat generated by glo-coil 83 in response to the energization thereof is transmitted through glass 141 and window 139 of detector housing 131 into chamber 133 thereof. It may be noted that the radiant heat so transmitted acts directly on strip **103*a* effecting a heat rise therein, but since strip 103*a* shields strip 103 from the radiant heat, there is established the thermal differential therebetween. Strip 103*a* will elongate generally to the right (as seen in FIG. 8) in response to the radiant heat acting directly thereon, and in this manner, elongation of strip 103*a* relative to shielded strip 103 pivotally moves adjacent opposite end portions 113, 113*a* about stationary adjacent opposite end portions 111, 111*a* and spacer 115 thereby to effect pivotal movement of the strips generally in a counterclockwise direction (as seen in FIG. 8). In other words, strip 103*a* forms one side of the aforementioned triangular truss or configuration, and when it expands, the adjacent opposite end portions 113, 113*a* of strips 103, 103*a* are pivoted generally upwardly relative spacer 115, since strip 103 and spacer 115 form the other sides of the triangular configuration. The force generated in response to the pivotal movement of strips 103, 103*a* is translated through drive pin 151 to drive switch blade 117 against the biasing force of its biasing spring 159 toward a circuit interrupting position disengaging movable contact 155 from stationary contact 157 thereby to open shunt circuit 13 and de-energize glo-coil 83. Upon the disengagement of contacts 155, 157 to open shunt circuit 13, power is now applied through lead 89 to effect energization of solenoid operated gas valve 85. When gas valve 85 is energized, it provides a flow of the combustible gas which is then ignited by the radiant heat emitted from glo-coil 83 which remains glowing due to its time constant for a period subsequent to its de-energization sufficient to insure good ignition of the flowing gas. Placing gas valve 85 in series with glo-coil 83 reduces the current applied to the glo-coil to an insignificent value thereby to effect de-actuation or de-energization thereof terminating its radiation of heat in accordance with its time constant. However, since the glas flowing from actuated gas valve 85 is ignited, the heat thereof will act on strip 103*a* to maintain strips 103, 103*a* in their pivoted or actuated position for driving switch blade 117 to its position opening shunt circuit 13**.

When thermostat 91 senses the predetermined high temperature value, it opens circuit 87 across power terminals $L_1$, $L_2$ thereby to effect de-energization of gas valve 85 wherein the supply or flow of gas is interrupted. When the gas flow is so interrupted, the flame or burning gas is, of course, extinguished thereby to interrupt or abruptly decrease radiant heat transmitted to detector 101. As the intensity of the radiant heat decreases, strip **103*a* of detector 101 cools so as to eventually eliminate the aforementioned thermal differential between strips 103, 103*a*, and upon such cooling, strip 103*a* contracts from its heated elongated dimension. This cooling contraction of strip 103*a* causes strips 103, 103*a* to pivotally return to their original position in housing 131. The return pivotal movement of strips 103, 103*a* to their original position relieves the force transmitted through drive pin 151 to switch blade 117, and the compressive force of biasing spring 159 of the switch blade moves it with snap-action to its original position re-engaging movable contact 155 with stationary contact 157. As will be recalled, thermostat 91 opened circuit across power terminals $L_1$, $L_2$; therefore, the application of power across detector 101 through closed contacts 155, 157 is obviated. It may be noted, however, that the closure of contacts 155, 157 resets detector 101 for the next cyclical operation of system 81 when thermostat 91** again senses the predetermined low temperature value, as previously described.

In view of the foregoing, it is now submitted that a novel method and system 81 have been provided meeting the objects and advantages set out hereinbefore, as well as others, and that changes may be made in the precise arrangements, shapes, details and connections of the component parts operable in the system and method, as well as the precise order of the steps of the method, by those having ordinary skill in the art without departing from the spirit of the invention or the scope thereof as defined by the claims which follow.

What I claim as new and desire to secure by Letters Patent of the United States is:

1. A system for operating apparatus utilizing a combustible gas comprising means for emitting radiant heat, means connected in circuit relation with said emitting means for supplying the combustible gas thereto to be ignited, and means for controlling the circuit relation of said emitting means so as to selectively effect energization of said emitting means and said supplying means, a pair of metallic strips each having a portion thereof respectively interconnected, means for pivotally mounting said strips spaced from said interconnected portions thereof and disposed with said strips so as to separate them, one of said strips being shielded at least in part with respect to the heat generated by said emitting means and said supplying means upon the energization thereof while the other of said strips is subjected to the heat so as to effect elongation of said other strip with respect to said one strip and pivotal movement of said interconnected portions of said strips generally about the pivotally mounting means, and means disposed between at least one of said one and other strips and said controlling means for driving it to a circuit controlling position respectively deenergizing said emitting means and energizing said supplying means so that the combustible gas from said supplying means is ignited by the remaining radiant heat of said emitting means.

2. A system as set forth in claim 1 further comprising condition responsive means operable generally upon the occurrence of a preselected condition for placing said emitting means, said supplying means and said controlling means across a power source.

3. A system as set forth in claim 1 wherein said controlling means is disposed in shunt circuit relation with said supplying means and in series circuit relation with said emitting means.

4. A system as set forth in claim 1, wherein said controlling means in a generally at-rest circuit controlling position thereof is operable generally upon the application of power thereto to shunt said supplying means and energize said emitting means.

5. A system for operating apparatus utilizing a combustible gas comprising a heat source including means energized upon the application of power thereto for emitting radiant heat, and means energized upon the application of power thereto for supplying a flow of the gas adapted to be ignited by the radiant heat of said emitting means, means connected in shunt circuit relation across said supplying means for controlling the energization of both said emitting means and said supplying means including means for applying power to said emitting means to effect the energization thereof and its emission of the radiant heat upon the occurrence of a preselected condition and movable toward a position for interrupting the application of power to said emitting means, a pair of generally elongate metallic strips each having a portion thereof respectively interconnected, means spaced from said interconnected portions of said strips for separating them, means for mounting at least said separating means so that said strips are pivotally movable relative thereto and wherein one of said strips is subjected to said heat source while shielding at least in part the other of said strips from said heat source, said one strip being elongatable upon the subjection thereof to said heat source with respect to said shielded other strip thereby to effect the pivotal movement of said strips, and means between at least one of said one and other strips and said applying means for effecting movement thereof toward its position interrupting the application of power to said emitting means to effect the de-energization thereof and establishing the application of power to said supplying means to effect the energization thereof and the flow of the gas for ignition by the remaining radiant heat of said emitting means.

6. A method of actuating means for detecting radiant heat from a source thereof, the detecting means having a pair of metallic strips with adjacent oppositely spaced portions thereof interconnected, the method comprising the steps of:

(a) shielding at least a part of one of the strips from the radiant heat source while subjecting the other of the strips thereto for effecting relative elongation of the strips and causing one of the interconnected adjacent oppositely spaced portions of the strips to pivot relative to the other of the interconnected adjacent oppositely spaced portions thereof; and (b) effecting the movement of means toward at least one position for controlling an electrical circuit in response to the pivotal movement of the strips.

7. The method as set forth in claim 6 wherein the shielding and causing step comprises disposing the strips generally in overlaying relation with each other.

8. The method as set forth in claim 6 wherein at least one of the strips includes means for enhancing the pivotal movement thereof.

9. The method as set forth in claim 6 wherein the shielding and causing step comprises supporting the other interconnected adjacent oppositely spaced portions to effect the pivoting of the one interconnected adjacent oppositely spaced portions relative thereto.

10. The method as set forth in claim 6 wherein the strips include means for separating the strips interconnected between the other adjacent oppositely spaced portion of the strips so that the strips are arranged in a generally triangular configuration, and wherein the shielding and causing step comprises arranging the separating means so that the at least part of the one strip is shielded from the radiant heat source.

11. The method as set forth in claim 10 wherein the shielding and causing step further comprises mounting the separating means within the detecting means so that the separating means and the strips generally define a truss having the generally triangular configuration.

12. The method as set forth in claim 6 wherein the movement effecting step comprises interrupting the application of power through the electrical circuit to deenergize means for emitting radiant heat upon the movement of the controlling means to its one circuit controlling position.

13. The method as set forth in claim 12 comprising the additional step of applying power to energize a means for supplying a combustible gas adapted to be ignited by the remaining radiant heat of the emitting means generally upon the deenergization thereof.

14. The method as set forth in claim 6 wherein the electrical circuit includes means adapted to be energized for emitting radiant heat and means adapted to be energized for supplying a flow of combustible gas for ignition by the radiant heat of the emitting means, and wherein the effecting step includes energizing the supplying means so as to flow the combustible gas to the emitting means and deenergizing the emitting means so that the gas flowed thereto is ignited by at least the remaining radiant heat of the emitting means when the controlling means is in its one circuit controlling position.

15. A method of actuating a pair of elongate strips respectively having a pair of adjacent opposite portions interconnected in a generally triangularly shaped truss mounted for pivotal movement in means for detecting radiant heat from a source thereof, said method comprising shielding at least in part one of the strips from the radiant heat while subjecting the other of the strips thereto so as to effect elongation of the other strip with respect to the one strip cause one of the pair of adjacent opposite portions of the strip to pivot generally about the other pair of adjacent opposite end portions of the strips.

16. The method as set forth in claim 15 comprising the additional step of driving a means for controlling an electrical circuit in response to the pivoting of the one pair of adjacent opposite portions of the strip.

17. The method as set forth in claim 16 comprising the further additional step of controlling the energization of means connected in circuit relation with the controlling means and operable generally for emitting radiant heat in response to the driving of the controlling means.

18. The method as set forth in claim 17 wherein the further additional step includes energizing a means connected in circuit relation with the controlling means and the radiant heat emitting means and operable generally for supplying a combustible gas to the radiant heat emitting means so as to be ignited thereby.

19. The method as set forth in claim 15 comprising the additional step of operating switch means in response to the pivoting of the one pair of adjacent opposite portions of the strip so as to deenergize means for emitting radiant heat and energizing a means for supplying a combustible gas to the radiant heat emitting means so as to be ignited by at least the remaining radiant heat thereof.

20. In a detector for radiant heat having a housing, means in the housing for admitting the radiant heat, a pair of elongate metallic strips disposed in the housing at least in part in overlaying relations and having adjacent portions thereof interconnected, and means mounted to the housing and spaced from the interconnected adjacent portions of the strips for interconnecting and separating the strip; a method of actuating the strips in response to the radiant heat admitted into the housing through the admitting means comprising shielding at least in part one of the strips from the radiant heat while subjecting the other of the strips thereto so as to effect elongation of the other strip with respect to the one strip and causing the interconnected adjacent portions of the strips to pivot generally about the interconnecting and separating means.

21. The method as set forth in claim 20 comprising the additional step of moving a means for controlling an electrical circuit toward at least one circuit controlling position thereof in response to the pivotal movement of the strips in one of a pair of opposite pivotal directions generally about the interconnecting and separating means.

22. The method as set forth in claim 21 comprising the further additional step of effecting the deenergization of means in the electrical circuit for emitting the radiant heat when the controlling means is in its at least one circuit controlling position.

23. The method as set forth in claim 22 wherein the further additional step comprises causing the energization of means in the electrical circuit for supplying a combustible gas to the emitting means so as to be ignited thereby when the controlling means is in its at least one circuit controlling position.

24. The method as set forth in claim 21 wherein the additional step comprises driving a means interposed between at least one of the one and other strips and the controlling means upon the pivotal movement of the strips in the one direction so as to effect the movement of the controlling means toward its at least one circuit controlling position.

* * * * *